United States Patent [19]

Schafer

[11] 4,020,895

[45] May 3, 1977

[54] METHOD AND APPARATUS FOR THE ALTERNATE HEATING AND COOLING OF A HEAT EXCHANGER OF A HEATING AND COOLING APPARATUS

[76] Inventor: Otmar U. Schafer, 9 Pienzenauer Strasse, Munich 80, Germany

[22] Filed: Nov. 12, 1975

[21] Appl. No.: 631,234

[30] Foreign Application Priority Data

Nov. 12, 1974 Germany ..... 2453622

[52] U.S. Cl. ..... 165/1; 165/2; 165/18; 165/48; 165/61; 165/104 R

[51] Int. Cl.[2] ..... F25B 13/00

[58] Field of Search ..... 165/1, 2, 14, 18, 48, 165/61, 104

[56] References Cited

UNITED STATES PATENTS

| | | | |
|---|---|---|---|
| 3,604,501 | 9/1971 | Brants | 165/1 |
| 3,608,624 | 9/1971 | Hasselriis | 165/1 |
| 3,653,429 | 4/1972 | Lawrence | 165/1 |
| 3,774,673 | 11/1973 | Ribesse | 165/1 |
| 3,842,901 | 10/1974 | McFarlan | 165/2 |

*Primary Examiner*—C. J. Husar
*Assistant Examiner*—Daniel J. O'Connor

[57] ABSTRACT

A heating and cooling apparatus with thermal recovery with two heat exchangers and method of alternately heating and cooling same, in which, during the warm-up phase, the cool liquid returning from a heat exchanger, and, during the cool-down phase, the hot liquid returning from a heat exchanger, are delivered to reservoirs from which, during the warm-up phase, hot liquid is taken for the hot liquid source, and, during the cool-down phase, cold liquid is taken for the cold liquid source, into which reservoirs both during the warm-up phase and during the cool-down phase amounts of liquid of different temperature are taken from the heat exchanger. The warm-up and cool-down phases of the second heat exchanger are out of step with the warm-up and cool-down phases of the first heat exchanger by a fraction of the length of these phases. The liquid from the first heat exchanger is used during the warm-up phase for the preheating of the second heat exchanger, and during the cool-down phase for the preliminary cooling thereof.

7 Claims, 7 Drawing Figures

METHOD AND APPARATUS FOR THE ALTERNATE HEATING AND COOLING OF A HEAT EXCHANGER OF A HEATING AND COOLING APPARATUS

BACKGROUND

The invention relates to a method of alternately heating and cooling a heat exchanger, such as a press or a reaction vessel, of a heating and cooling apparatus with thermal recovery, in which, during the warm-up phase, the cool liquid returning from the heat exchanger, and during the cool-down-phase, the hot liquid returning from the heat exchanger, is delivered to a reservoir from which, during the warm-up phase, hot liquid is taken for the heater, and in the cool-down phase, cold liquid is taken for the cooler, and in which at least two reservoirs are present, or two sections within one reservoir, into which amounts of liquid of different temperature are delivered from the heat exchanger both during the warm-up phase and during the cool-down phase. The invention furthermore relates to an apparatus for the practice of this method.

A method and an apparatus of this kind have been proposed in copending application Ser. No. 580,700 filed May 27, 1975. They are distinguished from the method disclosed by German Pat. No. 1,113,062 by an improved thermal recovery.

Both in the known method and in the proposed method, at least one reservoir is provided, which, in a certain cycle, is charged one time with hot and another time with cold liquid, or also, in the case of the older patent application, is charged with liquid of medium temperature. In these cases the liquid that is in the reservoir is expelled by a liquid of a different temperature. In this method unavoidable mixing losses occur, which diminish the amount of the possible thermal recovery.

The invention is addressed to the problem of devising a method and an apparatus to make it possible to reduce the percentage of the mixing losses in the overall process. Furthermore, the temperature range which can be economically utilized for the thermal recovery is to be expanded.

THE INVENTION

This problem is solved, insofar as the method is concerned, by the features described in Claim 1. Additional advantageous developments of the invention are to be found in the subordinate claims, and a still further improvement of the thermal recovery can be achieved corresponding to the teaching of the older patent application.

The invention will be further explained by examples of its embodiment, with the aid of seven figures in the appended drawings, wherein FIGS. 1 and 2 represent the temperature curves of water inlet and outlet temperature of two heat exchangers which can be connected together within a heating and cooling installation;

Figure 1:
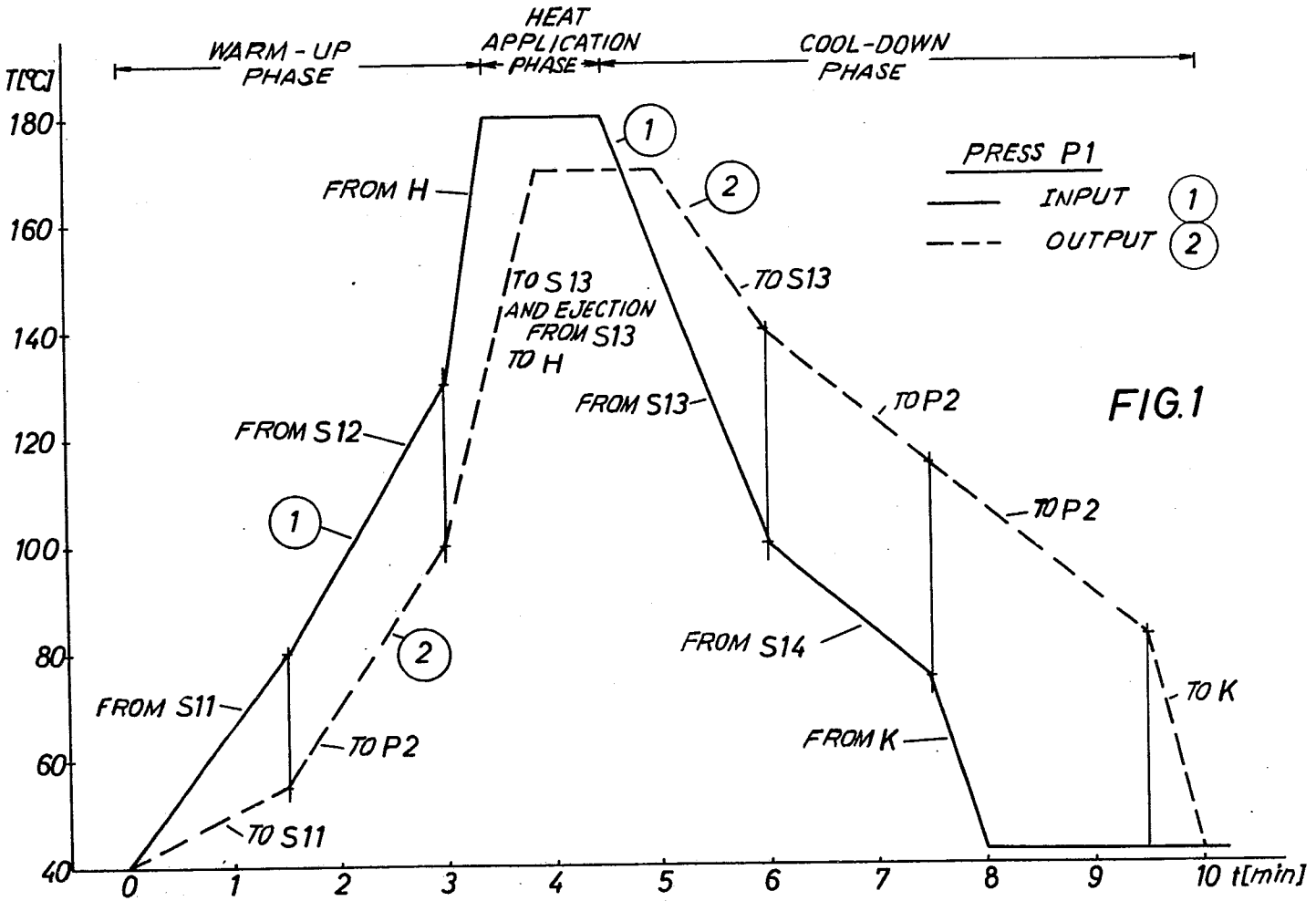
Figure 2:
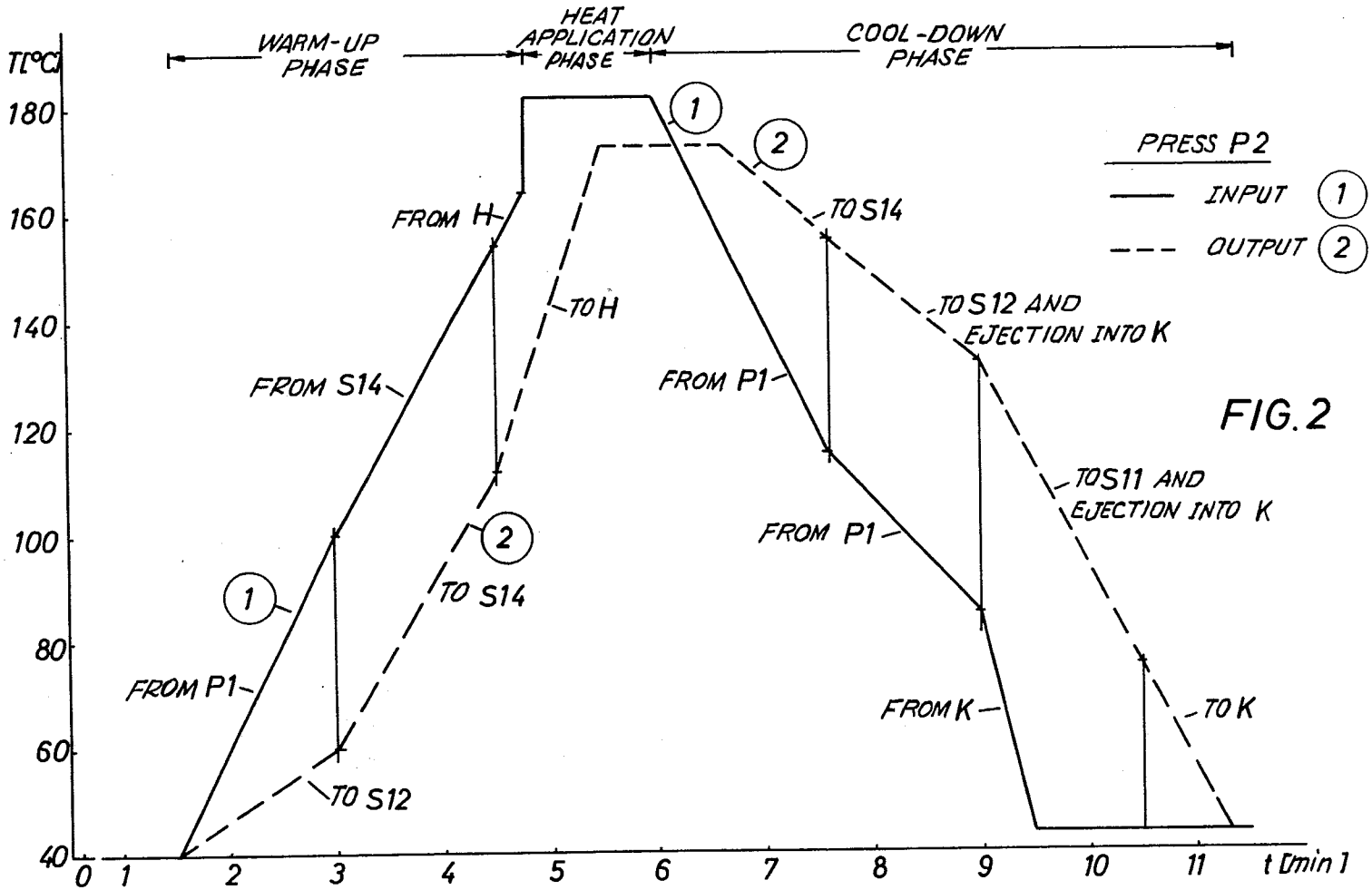

In the temperature diagrams of FIGS. 1 and 2 for two heat exchangers--in the present case two presses or two independently operated sections of a single press—of a heating and cooling apparatus, the solid curve 1 represents the water temperature at the point of admission to the press, i.e., the input temperature of the press, and the broken curve 2 represents the water temperature at the point of emergence from the press, i.e., the return temperature. The two temperature diagrams are to be considered in conjunction with one another, and they correspond to the conditions as they occur in the heating and cooling apparatus represented in FIG. 4.

Three phases are to be distinguished, namely a warmup phase in which the press is heated from a low temperature of about 40° C to a high temperature of about 165° C, a heat application phase in which the press is maintained at this high temperature, and a cool-down phase in which the press is cooled from this high temperature back down to the low temperature. For ease in understanding, the individual steps of the process will be specified by stating whence the water being fed to the press comes and whither it will go after leaving the press. The apparatus represented in FIG. 4 will be taken as the basis. In this diagram, H = the hot water source
K = the cold water source
P1 = Press 1
P2 = Press 2
S11 to S14 = four different reservoirs.

The size of the reservoirs corresponds to approximately one-third of the volume of the liquid that is circulated during the warm-up phase.

An important feature of the invention consists in the fact that, in contrast to the state of the art, or even to the older patent application, two heat exchangers, i.e., in the present case two presses P1 and P2 (they may also be sections of presses), are provided, and that, as it can be seen from a comparison of FIGS. 1 and 2, the warm-up and cool-down phases of the second press P2 are out of step with the warm-up and cool-down phases of the first press P1, and the liquid from the first press P1 is used to preheat the second press P2 during the warm-up phase in the first press P1 or during part of the heat application phase of the latter, and that the liquid from the first press P1 is used for the preliminary cooling of the second press P2 during the cool-down phase in the first press P1. In this manner the mixing losses, which otherwise occur in the operation of a press and are due to the entry into and departure from the reservoirs of quantities of liquid of different temperatures, are divided between two presses, so that the percentage of the mixing losses for the overall process is reduced. In addition, this increases the economically useful temperature range of the recycled water in comparison to a press whose size corresponds to the sum of the sizes of presses P1 and P2.

The sections marked off in the temperature diagrams of FIGS. 1 and 2 correspond to the process steps XI to XIX of the process that will be explained with reference to FIG. 4. Reference will be made to these sections in the discussion of FIG. 4.

Figure 3:
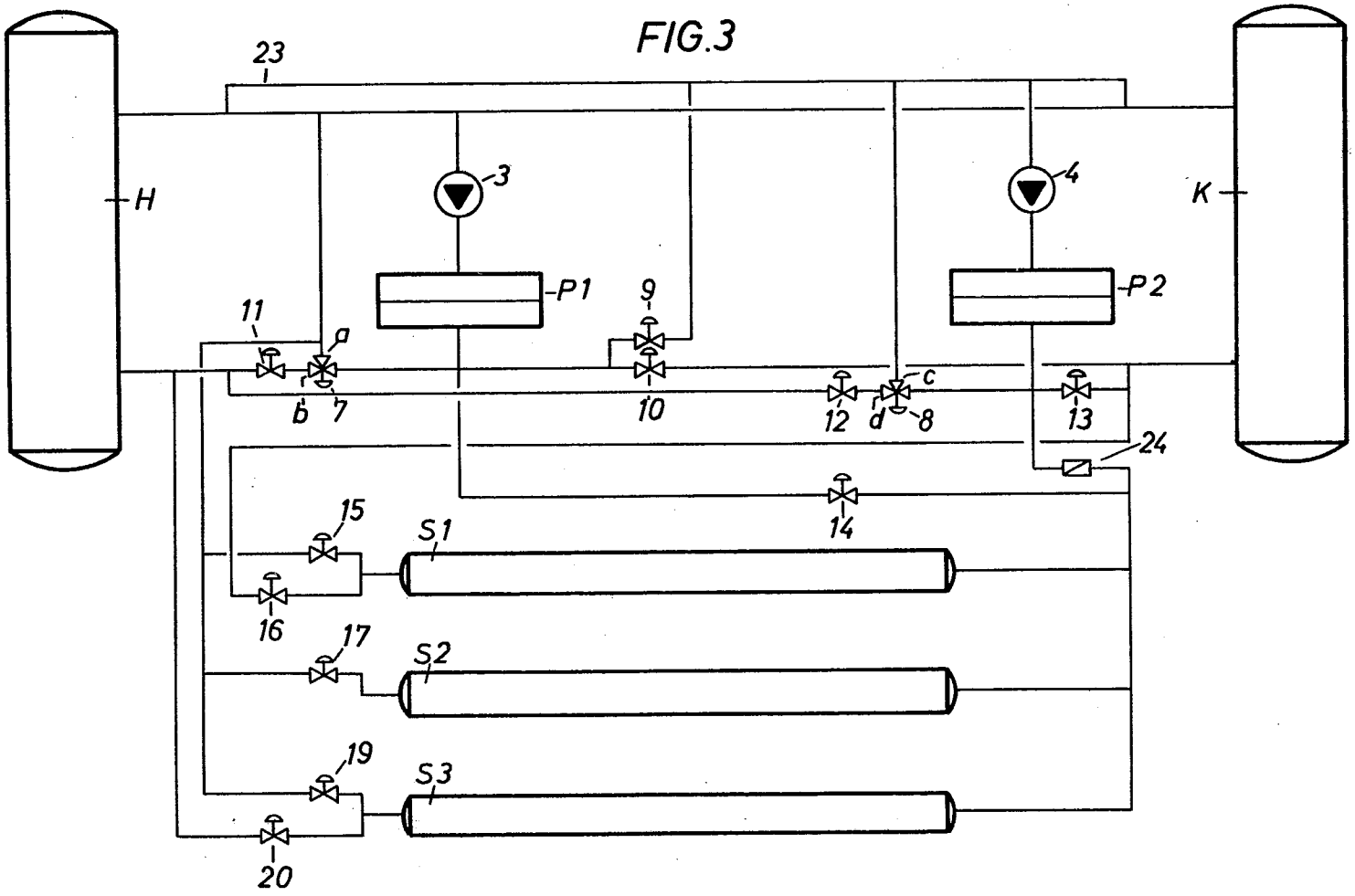
FIG. 3 represents a heating and cooling installation in accordance with the invention, which has two heat exchangers and three reservoirs.

In FIG. 3 there is represented a heating and cooling apparatus in accordance with the invention, with two presses P1 and P2 and three reservoirs S1, S2 and S3, with which the process of the invention can be performed. The apparatus contains, in addition to the presses and reservoirs, a hot water source H—in the present case the reservoir of a recirculating water boiler—, a cooler K—in the present case the cold water reservoir of a water cooler—, pumps 3 and 4, the former associated with press P1 and the latter with press P2, and each disposed at the point of admission to its respective press, three-way regulating valves 7 and 8, reversing valves 9 to 17 and 19 and 20, and connecting lines generally designated as 23. In addition, a non-return valve 24 is provided.

With the apparatus described, by means of the operation of the valves as specified in Table 1, the following steps of the process can be performed:

Upon the changeover from cooling to heating, the liquid is circulated in the following manner:

I. With the circuit cold water source K — second heat exchanger P2 — cold water source K running, the liquid is circulated in the circuit first reservoir S1 — first heat exchanger P1 — first reservoir S1; then II. In the circuit second reservoir S2 — first heat exchanger P1 — second heat exchanger P2 — second reservoir S2; then III. In the circuit hot water source H — first heat exchanger P1 — second heat exchanger P2 — hot water source H, and finally IV. in the circuit hot water source H — first heat exchanger P1 — hot water source H, on the one hand, and in the circuit hot water source H — second heat exchanger P2 — reservoir S3 — hot water source H, on the other hand, and, upon the changeover from heating to cooling, it is circulated in the following manner:

V. First, with the circuit hot water source H — second heat exchanger P2 — hot water source H still running, liquid is circulated in the circuit third reservoir S3 — first heat exchanger P1 — third reservoir S3; then VI. in the circuit second reservoir S2 — first heat exchanger P1 — second heat exchanger P2 — second reservoir S2; then VII. in the circuit cold water source K — first heat exchanger P1 — second heat exchanger P2 — first reservoir S1 — cold water source K, and lastly VIII. in the circuit cold water source K — first heat exchanger P1 — cold water source K, on the one hand, and in the circuit cold water source K — second heat exchanger P2 — cold water source K, on the other.

In this series of operations of the process, the warm-up and cool-down phases of the presses P1 and P2 are out of step according to the teaching of the invention, and the return liquid from the first press P1 is used for preheating the second press P2 during the warm-up phase and for precooling it during the cool-down phase. In Table 1, the circuits I to VIII correspond to the process steps I to VIII.

In the case of the apparatus represented in FIG. 3, as indicated in Table 1, in process step I, i.e., at the beginning of the warm-up in press P1, the hot water is brought from reservoir S1 into this press, which in some cases can result in unacceptable thermal stresses. On the other hand, in this step of the process the hot water is displaced by the cold water delivered from the press P1. The temperature difference is thus relatively high at the interface between the two amounts of water and hence the mixing losses are also relatively high. If an additional reservoir is adopted it is possible to store amounts of liquid of different temperature ranges between the low temperature and the high temperature in separate reservoirs or separate sections of reservoirs and, upon the changeover from cooling to heating, to bring into press P1 the amount of liquid contained in the reservoir of lowest temperature, followed by the amounts of liquid of the next higher temperatures, so as to raise the temperature of Press P1 more gradually, and, upon the changeover from heating to cooling, to bring the contents of the reservoir of highest temperature into press P1, followed by the amounts of liquid of successively lower temperature, so as to reduce the temperature of press P1 more gradually. In this manner excessive thermal stresses in the press are avoided, and on the other hand, since in the charging or discharging of the reservoirs the temperature differences between the amounts of liquid being stored and released are not so great, the mixing losses are diminished, so that the thermal recovery can be still further improved. This principle is embodied in the heating and cooling apparatus represented in FIG. 4.

Figure 4:
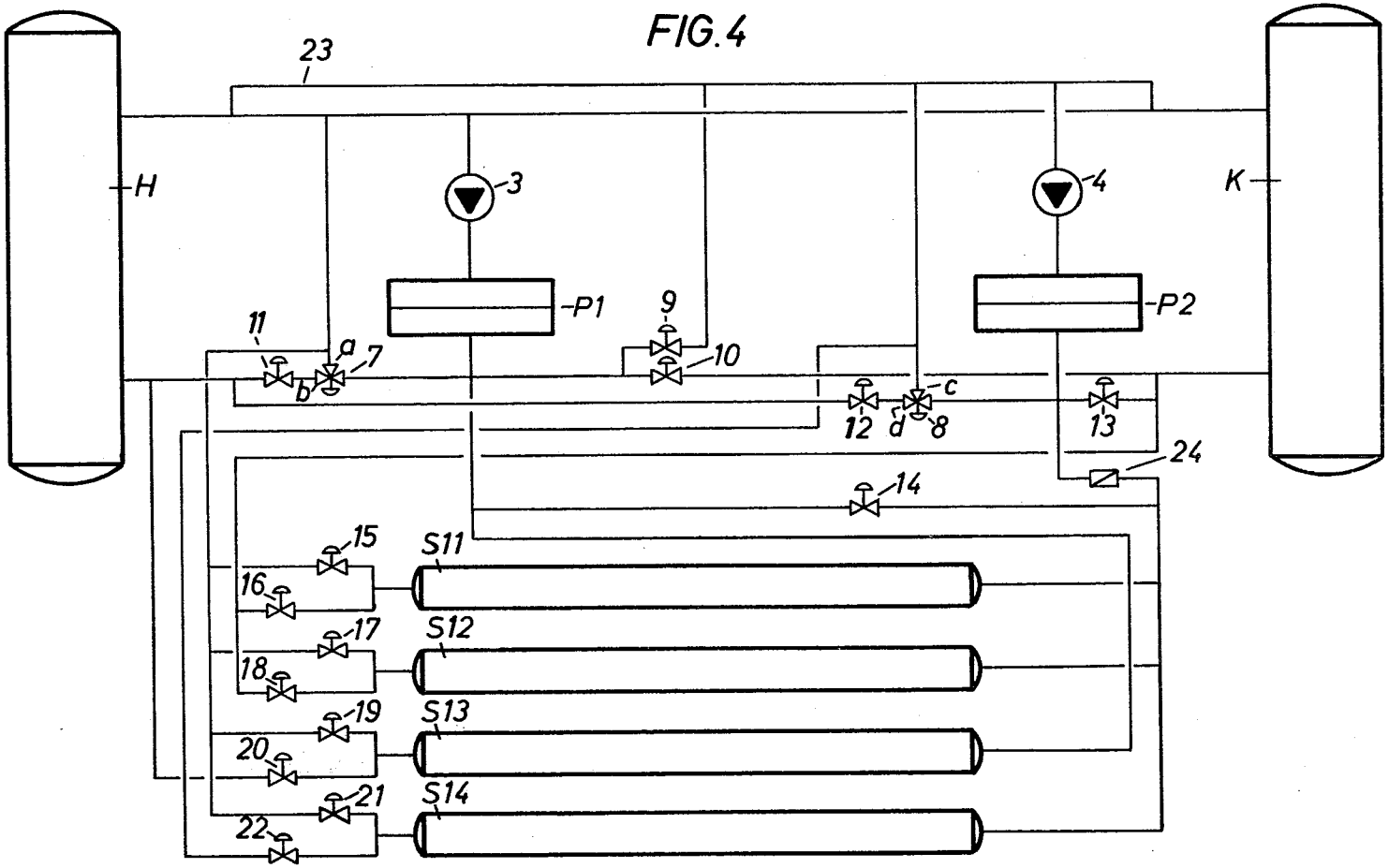
FIG. 4 represents a heating and cooling installation in accordance with the invention, which has two heat exchangers and four reservoirs.

The apparatus represented in FIG. 4 differs from the one in FIG. 3 in that it contains four reservoirs S11 to S14 instead of three reservoirs S1 to S3, and additional reversing valves 18, 21 and 22. The rest of the parts of the apparatus are the same as those in the apparatus of FIG. 3, and are therefore identified in the same manner. For the performance of the process of the invention, the following steps of the process are executed by operating the valves as indicated in Table 2.

Upon the changeover from cooling to heating, the liquid is circulated in the following manner:

XI. With the circuit cold water source K — second heat exchanger P2 — cold water source K running, the liquid is circulated in the circuit first reservoir S11 — first heat exchanger P1 — first reservoir S11; then, XII. in the circuit second reservoir S12 — first heat exchanger P1 — second heat exchanger P2 — second reservoir S12; then, XIII. in the circuit hot water source H — first heat exchanger P1 — third reservoir S12 — hot water source H, on the one hand, and in the circuit fourth reservoir S14 — second heat exchanger P1 — fourth reservoir S14, on the other hand; then XIV. in the circuit hot water source H — first heat exchanger P1 — hot water source H, on the one hand, and in the circuit hot water source H — second heat exchanger P2 — hot water source H, on the other hand, and upon the changeover from heating to cooling, the liquid is circulated as follows:

XV. With the circuit hot water source H — second heat exchanger P2 — hot water source H running, the liquid is circulated simultaneously in the circuit third reservoir S13 — first heat exchanger P1 — third reservoir S13; then XVI. in the circuit fourth reservoir S14 — first heat exchanger P1 — second heat exchanger P2 — fourth reservoir S14; then, XVII. in the circuit cold water source K — first heat exchanger P1 — second heat exchanger P2 — second reservoir S12 — cold water source K; then XVIII. in the circuit cold water source K — first heat exchanger P1 — cold water source K, on the one hand, and in the circuit cold water source K — second heat exchanger P2 — first reservoir S11 — cold water source K on the other, and finally XIX. in the circuit cold water source K — first heat exchanger P1 — cold water source K, on the one hand, and in the circuit cold water source K — second heat exchanger P2 — cold water source K, on the other.

In Table 2, the circuits XI to XIX correspond to process steps XI to XIX.

As Table 2 shows, quantities of liquid of low temperature are used for preheating press 1 or press 1, as the case may be, and high temperatures are used for the preliminary cooling of press 1 or press 2.

In the apparatus represented in FIGS. 3 and 4, two separate presses P1 and P2 are the heat exchangers. Instead of two or even more presses, a single press can also be provided, having two or more sections which can be heated and cooled independently of one another. The basic construction of such presses is shown in the open state in FIGS. 5 to 7.

Figure 5:
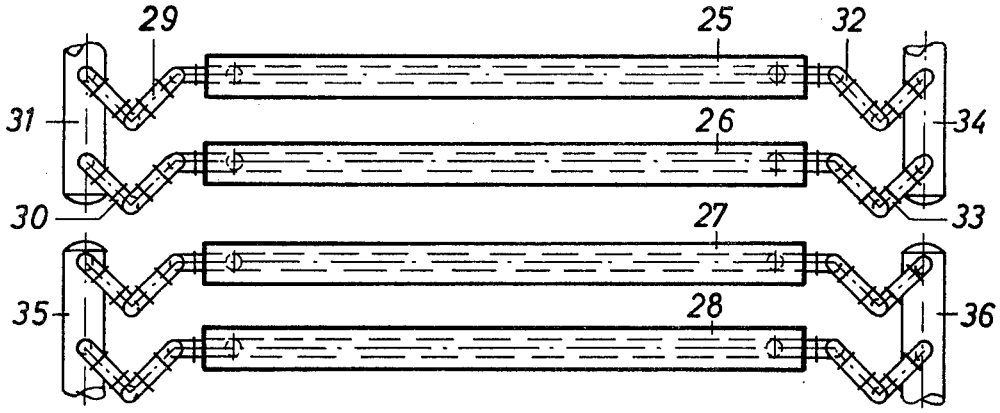
FIG. 5 is a diagrammatic representation of the structure of a three-stage press.

FIG. 5 is a diagrammatic representation of a three-stage press having four heating platens 25 to 28. The material to be pressed is placed between these platens. The heating platens 25 and 26 are connected by means of articulated pipes 29 and 30, or by flexible hoses, to a return manifold 34. Similar connections exist between the heating platens 27 and 28 and an additional input manifold 35 on the one side and an additional return manifold 36 on the other side. The input manifolds 31 and 36 and the return manifolds 34 and 36 are connected in a manner similar to that represented in FIGS. 3 and 4 for the presses P1 and P2. In other words, the input manifold 31 is connected, for example, to pump 3, and the input manifold 35 to pump 4, and the return manifold to the reversing valve 14 or to the non-return valve 24, as the case may be. After the material to be pressed has been placed between the heating platens 25 and 26, and between platens 26 and 27, and between platens 27 and 28, the heating platens are brought together and the required pressure is applied to them. In addition, the press sections consisting of platens 25 and 26, on the one hand, and of platens 27 and 28 on the other, are heated and cooled in accordance with the sequence of operations explained with reference to FIGS. 3 and 4. At the end of the prescribed thermal cycle, the individual platens are drawn apart again and the pressed material is removed.

In the example represented in FIG. 5, only two heating platens are associated with one press section. A greater number of platens operated in parallel can, of course, also be provided. The construction of a platen can be seen in the perspective representation in FIG. 6.

Figure 6:
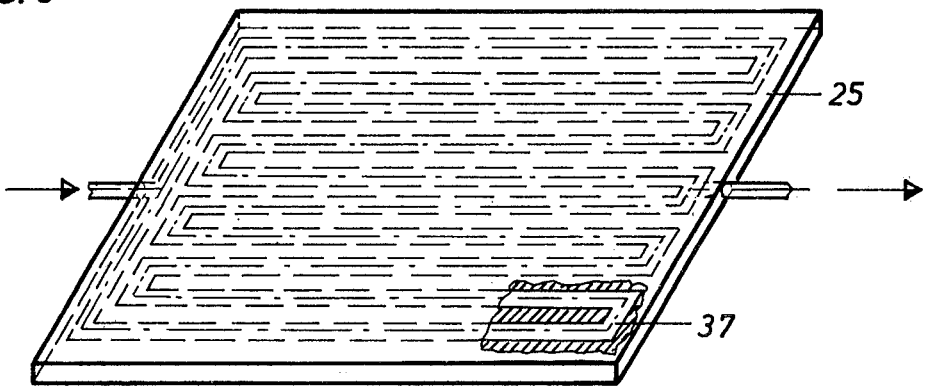
FIG. 6 is a perspective view of a platen of this press.

The press platen of FIG. 6 contains a series of passages 37 which are connected partially in parallel, and through which the liquid used as the heat carrier flows.

Figure 7:
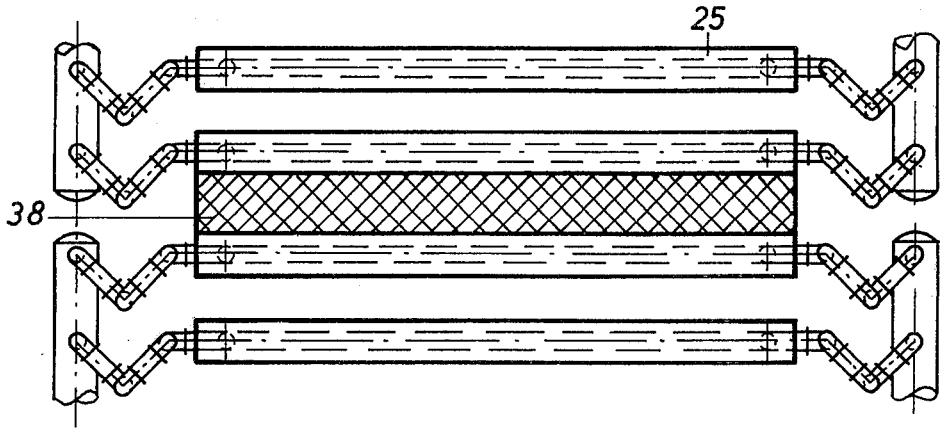
FIG. 7 is a diagrammatic representation of the structure of a two-stage press.

In FIG. 7 there is represented an additional example of a press containing two independent, heatable and coolable press sections. In contrast to the press of FIG. 5, a thermal insulation board 38 is inserted between the heating platens 26 and 27, such insulating board being able to consist, for example, of asbestos-synthetic resin mixed with asbestos-cement. This, therefore, is a two-stage press which will be used instead of the three-stage press represented in FIG. 5 when the material to be pressed must not be exposed during the warm-up phase and during the cool-down phase to the temperature difference between platen 26 and 27 produced by the phase shift between the temperature curves of the two sections.

In the examples of the method according to the present invention as described above, two heat exchangers of same size are provided and the temperature curves (see FIGS. 1 and 2) are similar. Finally, the curves are offset from each other, as far as time is concerned by the same amount from cycle to cycle. However, the method according to the present invention can also be applied advantageously if the heat exchangers, for instance vulcanizing presses for tires of different sizes, are of different size, if the temperature curves of the individual heat exchangers are different as far as the temperature level and extension as to time is concerned, and finally if the offset between phases is different from cycle to cycle.

Table 1

| Circuit | Position of Valve 7 | 8 | 9 | 10 | 11 | 12 | 13 | 14 | 15 | 16 | 17 | 19 | 20 | Reservoir Temp. Range* S1 | S2 | S3 |
|---|---|---|---|---|---|---|---|---|---|---|---|---|---|---|---|---|
| I | a − b + | c − d + | − | − | − | − | + | + | + | − | − | − | − | 120/80 | 165/120 | 165/140 |
| II | a − b + | c − d + | + | − | − | − | − | − | − | − | + | − | − | 40/60 | 165/120 | 165/140 |
| III | a − b + | c − d + | + | − | − | + | − | − | − | − | − | − | − | 40/60 | 40/60 | 165/140 |
| IV | a + b + | c − d + | − | − | + | − | − | − | − | − | − | − | + | 40/60 | 40/60 | 165/140 |
| V | a − b + | c + d + | − | − | − | + | − | − | − | − | − | + | − | 40/60 | 40/60 | 150/120 |
| VI | a − b + | c − d + | + | − | − | − | − | − | − | − | + | − | − | 40/60 | 40/60 | 165/140 |
| VII | a − b + | c − d + | + | − | − | − | − | − | + | − | − | − | − | 40/60 | 165/120 | 165/140 |
| VIII | a + b − | c + d − | − | + | − | − | + | − | − | − | − | − | − | 120/80 | 165/120 | 165/140 |

+ Signifies that valve is open.
− Signifies that valve is closed.
* in ° C at start of process step Table 2

| Circuit | Position of the Valve 7 | 8 | 9 | 10 | 11 | 12 | 13 | 14 | 15 | 16 | 17 | 18 | 19 | 20 | 21 | 22 | Reservoir Temp. Range* S11 | S12 | S13 | S14 |
|---|---|---|---|---|---|---|---|---|---|---|---|---|---|---|---|---|---|---|---|---|
| XI | a − b + | c − d + | − | − | − | − | +/+ | + | − | − | − | − | − | − | − | 1-20/70 | 140/120 | 165/140 | 165/140 | |

Table 2-continued

| Circuit | Position of the Valve 7 | 8 | 9 | 10 | 11 | 12 | 13 | 14 | 15 | 16 | 17 | 18 | 19 | 20 | 21 | 22 | Reservoir Temp. Range* S11 | S12 | S13 | S14 |
|---|---|---|---|---|---|---|---|---|---|---|---|---|---|---|---|---|---|---|---|---|
| XII | a − | c − | | | | | | | | | | | | | | | | | | |
| | b + | d + | + | − | − | − | − | − | − | − | + | − | − | − | − | − | 40/60 | 140/120 | 165/140 | 165/140 |
| XIII | a − | c − | | | | | | | | | | | | | | | | | | |
| | b + | d + | − | − | − | − | − | − | − | − | − | − | − | + | − | + | 40/60 | 40/60 | 165/140 | 165/140 |
| XIV | a + | c − | | | | | | | | | | | | | | | | | | |
| | b + | d + | − | − | + | + | − | − | − | − | − | − | − | − | − | − | 40/60 | 40/60 | 140/100 | 110/70 |
| XV | a − | c + | | | | | | | | | | | | | | | | | | |
| | b + | d + | − | − | − | + | − | − | − | − | − | − | + | − | − | − | 40/60 | 40/60 | 140/100 | 110/70 |
| XVI | a − | c − | | | | | | | | | | | | | | | | | | |
| | b + | d + | + | − | − | − | − | − | − | − | − | − | − | − | + | − | 40/60 | 40/60 | 165/140 | 110/70 |
| XVII | a − | c − | | | | | | | | | | | | | | | | | | |
| | b + | d + | + | − | − | − | − | − | − | − | − | + | − | − | − | − | 40/60 | 40/60 | 165/140 | 165/140 |
| XVIII | a − | c − | | | | | | | | | | | | | | | | | | |
| | b + | d + | − | + | − | − | − | − | − | + | − | − | − | − | − | − | 40/60 | 140/120 | 165/140 | 165/140 |
| XIX | a + | c + | | | | | | | | | | | | | | | | | | |
| | b − | d − | − | + | − | − | + | − | − | − | − | − | − | − | − | − | 120/70 | 140/120 | 165/140 | 165/140 |

+ Signifies that valve is open.
− Signifies that valve is closed.
* in ° C at start of process step

I claim:

1. In a method of alternately heating and cooling heat exchanger means, such as a press or a reaction vessel, of a heating and cooling apparatus with thermal recovery, having a hot liquid source and a cold liquid source, in which, during the warm-up phase, the cool liquid returning from the heat exchanger, and, during the cool-down phase, the hot liquid returning from the heat exchanger, are delivered to one of at least two reservoirs, from which one reservoir, during the warm-up phase, hot liquid is taken for the hot liquid source, and, during the cool-down phase, cold liquid is taken for the cold liquid source, into which two reservoirs both during the warm-up phase and during the cool-down phase amounts of liquid of different temperature are taken from the heat exchanger, the improvement comprising: providing at least a first and second heat exchanger means, making the warm-up and cool-down phases of said second heat exchanger means out of step with the warm-up and cool-down phases of said first heat exchanger means by a fraction of the length of these phases, and using the liquid from the first heat exchanger means during the warm-up phase for the preheating of the second heat exchanger means, and during the cool-down phase for the preliminary cooling thereof.

2. The method of claim 1, wherein said first and second heat exchanger means is a single heat exchanger with separate first and second heat exchanger sections.

3. The method of claim 1, wherein the apparatus is provided with a plurality of circuits with a first and a second heat exchanger and a first, second and third reservoir, comprising: circulating the liquid, upon the changeover from cooling to heating as follows:

I. While the circuit cold liquid source — second heat exchanger — cold liquid source is maintained, on the one hand, in the circuit first reservoir — first heat exchanger — first reservoir, on the other; then II. In the circuit second reservoir — first heat exchanger —second heat exchanger — second reservoir; then III. In the circuit hot liquid source — first heat exchanger —second heat exchanger — hot liquid source, and lastly IV. In the circuit hot liquid source — first heat exchanger —hot liquid source, on the one hand, and in the circuit hot liquid source — second heat exchanger — reservoir —hot liquid source, on the other, and circulating the liquid, upon the changeover from heating to cooling:

V. While the circuit hot liquid source — second heat exchanger — hot liquid source is at first maintained, on the one hand, in the circuit third reservoir — first heat exchanger — third reservoir, on the other, then VI. In the circuit second reservoir — first heat exchanger —second heat exchanger — second reservoir, then VII. In the circuit cold liquid source — first heat exchanger —second heat exchanger — first reservoir — cold liquid source, and lastly VIII. In the circuit cold liquid source — first heat exchanger —cold liquid source, on the one hand, and in the circuit cold liquid source — second heat exchanger — cold liquid source, on the other.

4. The method of claim 1, wherein the apparatus is provided with a plurality of circuits with a first and a second heat exchanger and a first, second, third and fourth reservoir, circulating the liquid, upon the changeover from cooling to heating as follows:

I. While the circuit cold liquid source — second heat exchanger — cold liquid source is at first maintained, in the circuit first reservoir — first heat exchanger —first reservoir, then II. In the circuit second reservoir — first heat exchanger —second heat exchanger — second reservoir, then III. In the circuit hot liquid source — first heat exchanger —third reservoir — hot liquid source, on the one hand, and fourth reservoir — second heat exchanger — fourth reservoir, on the other, then IV. In the circuit hot liquid source — first heat exchanger —hot liquid source, on the one hand, and in the circuit hot liquid source — second heat exchanger — hot liquid source, on the other, and that, upon the changeover from heating to cooling, circulating the liquid:

V. While the circuit hot liquid source — second heat exchanger — hot liquid source is at first maintained, on the one hand, in the circuit third reservoir — first heat exchanger — third heat exchanger, on the other, then VI. In the circuit fourth reservoir — first heat exchanger — second heat exchanger — fourth reservoir, then VII. In the circuit cold liquid source — first heat exchanger — second heat exchanger — second reservoir — cold liquid sourcce, then VIII. In the circuit cold liquid source — first heat exchanger — cold liquid source, on the one hand, and in the circuit cold liquid source — second heat exchanger — first reservoir — cold liquid source, on the other, and lastly IX. In the circuit cold liquid source — first heat exchanger — cold liquid source, on the one hand, and in the circuit cold liquid source — second heat exchanger — cold liquid source, on the other.

5. The method of claim 1, wherein the heat exchangers are in the form of presses.

6. The method of claim 1, wherein the heat exchangers are in the form of parts of a single press.

7. The method of claim 1, wherein, upon the changeover from cooling to heating, the amount of liquid in the reservoir having the lowest temperature, followed successively by the stored amounts of liquid of progressively higher temperature, is delivered to the first heat exchanger to preheat same, and, upon the changeover from heating to cooling, the amount of liquid in the reservoir having the highest temperature, followed successively by the stored amounts of liquid of progressively lower temperature, is delivered to the first heat exchanger for the preliminary cooling thereof.

* * * * *